US005459182A

United States Patent [19]

Peeters et al.

[11] Patent Number: 5,459,182

[45] Date of Patent: Oct. 17, 1995

[54] ADHESION PROMOTERS FOR ESTER-CURING RESIN BINDERS FOR THE FOUNDRY INDUSTRY

[75] Inventors: Hermann Peeters, Siegburg; Reinhard Matthes, Bergisch Gladbach, both of Germany

[73] Assignee: Huels Aktiengesellschaft, Marl, Germany

[21] Appl. No.: 271,126

[22] Filed: Jul. 6, 1994

[30] Foreign Application Priority Data

Jul. 21, 1993 [DE] Germany ..... 43 24 384.3

[51] Int. Cl.[6] ..... C08K 5/15; C08K 5/32

[52] U.S. Cl. ..... 524/114; 524/265

[58] Field of Search ..... 524/114, 265

[56] References Cited

U.S. PATENT DOCUMENTS

| | | | |
|---|---|---|---|
| 3,100,753 | 8/1963 | Spencer | 524/265 |
| 4,256,623 | 3/1981 | Junger et al. | 164/43 |
| 4,468,359 | 8/1984 | Lemon et al. | 264/82 |
| 4,474,904 | 10/1984 | Lemon et al. | 523/146 |
| 4,996,112 | 2/1991 | Perrin et al. | 428/447 |
| 5,089,540 | 2/1992 | Ambruster et al. | 523/212 |
| 5,169,880 | 12/1992 | Yoshida et al. | 523/145 |

*Primary Examiner*—Kriellion S. Morgan
*Attorney, Agent, or Firm*—Felfe & Lynch

[57] ABSTRACT

Organofunctional silanes, especially epoxy-functional silanes or mixtures of epoxy-functional silanes and alkylsilanes, are used as adhesion promoters for ester-curing resin binders for the foundry industry.

2 Claims, No Drawings

ADHESION PROMOTERS FOR ESTER-CURING RESIN BINDERS FOR THE FOUNDRY INDUSTRY

FIELD OF THE INVENTION

This invention relates to a novel method of promoting the adhesion of ester-curing resin binders for the foundry industry with organofunctional silanes, as well as to resin binder compositions containing such organofunctional silane adhesion promoters.

BACKGROUND OF THE INVENTION

It is known that synthetic resins can be used as binders for inorganic-oxidic materials such as sand in the production of foundry articles. Cold-curing resin systems based on phenolic resins, furan resins or 2-component polyurethane resins, for instance, are of great importance. A resin system which was introduced some years ago is an alkali/phenol/formaldehyde binder which is cured by an ester as a gassing agent or as a liquid. These foundry resin systems are described, for instance, in published European Applications Nos. 85512 and 86615. Such a resin system is called an ester-curing resin.

It is also known that selected organofunctional silanes improve the adhesion of resins to inorganic-oxidic materials (see German Offenlegungsschrift No. 28 29 669). The aforementioned published European patent applications disclose that aminoalkyltrialkoxysilanes, such as 3-aminopropyltriethoxysilane, improve the adhesion when added to ester-curing resins.

However, for many applications the adhesion between the resin binder and the inorganic-oxidic material was only slight, and consequently the strength of the shaped articles produced therefrom, such as cores or shells of foundry molds, was unsatisfactory. In connection with the solution of this problem consideration had to be given to the fact that the ester-curing resins are aqueous, highly alkaline systems having a pH of more than 12. With the exception of aminofunctional silanes, organofunctional silanes are not stable in an aqueous alkaline medium and condense very rapidly after hydrolysis to form polysiloxanes (Noll, *Chemie Und Technologie der silicone,* Verlag Chemie, Weinheim, Germany, 1968; and Plueddemann, *Silane Coupling Agents,* Plenum, N.Y., 1982).

OBJECTS OF THE INVENTION

It is an object of the present invention to provide a method for improving the adhesion of ester-curing resin binders used in the foundry industry.

Other objects and advantages of the present invention will become apparent as the description thereof proceeds.

DESCRIPTION OF THE INVENTION

The above object is achieved according to the present invention by using a silane of the formula

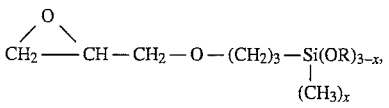

$$\underset{\diagup\ \diagdown}{CH_2}\!\!-\!\!\overset{O}{}\!\!-CH-CH_2-O-(CH_2)_3-\underset{(CH_3)_x}{\underset{|}{Si}}(OR)_{3-x}, \quad (I)$$

wherein

R is alkyl of 1 to 8 carbon atoms or aryl, and x is 0 or 1, or a mixture of a silane of the formula I with an alkylsilane of the formula

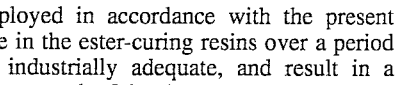

$$CH_3-(CH_2)_n-\underset{(CH_3)_x}{\underset{|}{Si}}(OR)_{3-x}, \quad (III)$$

wherein

R and X have the same meaning as in formula I, and n is an integer from 1 to 17, inclusive, as adhesion promoters for ester-curing resin binders for the foundry industry.

The silanes employed in accordance with the present invention are stable in the ester-curing resins over a period of time which is industrially adequate, and result in a considerably higher strength of the shaped articles produced by means of the resins than amino-functional silanes.

The epoxy-functional silanes of the formula I and the alkylsilanes of the formula II are known compounds and are employed on a large industrial scale, for example as adhesion promoters in non-aqueous resin systems or for coatings from dilute organic or aqueous solution at a pH of not more than 7.

Specific examples of such compounds of the formula I are the following:

3-glycidyloxypropyltrimethoxysilane,
3-glycidyloxypropyltriethoxysilane,
3-glycidyloxypropyltri-n-propoxysilane,
3-glycidyloxypropyltri-iso-propoxysilane,
3-glycidyloxypropyl-methyl-dimethoxysilane, and
3-glycidyloxypropyl-methyl-diethoxysilane.

Specific examples of compounds of the formula II are the following:

methyltri(m) ethoxysilane,
ethyltri(m)ethoxysilane,
n-propyltri(m)ethoxysilane,
n-propylmethyldimethoxysilane,
iso-butyltri(m)ethoxysilane,
octyltriethoxysilane, and
octadecyltrimethoxysilane.

After the ester-curing resin is prepared, the silane of the formula I or the mixture of silanes of the formulas I and II is added thereto at a temperature of 0° to 40° C., preferably between 0 and less than 30° C. The amount added is 0.05 to 2% by weight, preferably 0.1 to 0.6% by weight. The adhesion-promoting action and the stability of the silanes of the formulas I or II in the highly alkaline aqueous systems are surprising and unobvious. Thus, upon addition of 0.5 part by weight of 3-glycidyloxypropyltrimethoxysilane to 99.5 parts by weight of water at a pH of 11, a water-insoluble solid forms within less than 5 minutes due to hydrolysis of the silane, immediately followed by condensation into polysiloxanes which are inactive as adhesion promoters. The silanes of the formulas I and II which are employed as adhesion promoters in accordance with the present invention are stable in aqueous alkali/phenol/formaldehyde resin solutions with a pH of about 11 to 12 for the customary use period of 3 months and display an excellent adhesion promoting action. The silanes are employed in the form of the epoxy-functional silanes of the formula I by themselves or in combination with an alkylsilane of the formula II, the weight ratio of silane I to silane II being about 1:2 to 10:1. The epoxy-functional silanes having alkoxy groups which contain more than one carbon atom, such as the triethoxysilanes and tripropoxysilanes, are especially suitable for use as adhesion promoters in accordance with the present invention.

Low boiling point and readily hydrolyzable esters, especially methyl formate, are used as curing agents for the ester-curing resins in the case of gas curing, the gassing time being a few seconds. Liquid curing agents are especially polyalcohol esters of acetic acid, such as ethylene glycol or glycerolesters. The amount of liquid-curing agent is about 15 to 35% by weight, based on the weight of resin. The amount of resin is usually 1.0 to 3.0% by weight, based on the amount of sand.

The following examples illustrate the present invention and will enable others skilled in the art to understand it more completely. It should be understood, however, that the invention is not limited solely to the particular examples given below.

Resin 1 mentioned therein was an aqueous alkaline phenol/formaldehyde polymer having a viscosity of 190 cP at 25° C., a pH of 12.2, and a density of 1.29 g/cm$^3$ at 20° C.

Resin 2 was an aqueous alkaline phenol/formaldehyde polymer having a viscosity of 160 cP at 25° C., a pH of 12.5, and a density of 1.22 g/cm$^3$ at 20° C.

EXAMPLE 1

(Gas Curing)

2 kg of quartz sand H 31 were introduced into a planetary mixer and were intensively mixed for about 3 minutes with 25 g of resin 1 to which a silane was added at different times. Processing of the finished mixture was carried out over a period of 30 minutes by introducing it into a special +GF+ mold and compacting it by ramming three times. The +GF+ mold was made up of a 22+22 +170 mm steelbody with four built-in base screens and a gas feed in the firmly fitting lid. The mixture in the mold was gassed for 30 seconds with methyl formate which was entrained by a stream of nitrogen gas, and the mold was then flushed with nitrogen for i minute. The mixture was then released from the mold, and test specimens were stored over varying periods of time under normal conditions (NC), i.e. at 50% relative humidity and 23° C. Thereafter, the flexural strength was determined with the aid of three test specimens in a +GF+ bending tester, and the average value was determined. The range of scatter of the individual values was very low.

The following Table shows the results which were obtained.

TABLE 1

(resin 1)

| Specimen No. | Silane | Amount of silane [% by wt.] | Storage time of silane/resin mixture [days] | Flexural strength [N/cm$^2$] After 1 hr | Flexural strength [N/cm$^2$] After 24 hrs |
|---|---|---|---|---|---|
| 1A1 | no silane | — | | 10 | 10 |
| 1B1 | 3-aminopropyltriethoxysilane | 0.25 | 1 | 85 | 100 |
| 1C1 | 3-aminopropyltriethoxysilane, technical-grade | 0.25 | 1 | 85 | 95 |
| 1D1 | aqueous aminosilane hydrolysate, alcohol-free (DYNASYLAN 1151/HULS AG) | 0.25 | 1 | 70 | 95 |
| 1E1 | 3-glycidyloxypropyltrimethoxy-silane | 0.25 | 1 | 90 | 110 |
| 1A2 | no silane | — | | 10 | 10 |
| 1B2 | 3-aminopropyltriethoxysilane | 0.25 | 40 | 60 | 90 |
| 1C2 | 3-aminopropyltriethoxysilane, technical-grade | 0.25 | 40 | 70 | 85 |
| 1D2 | aqueous aminosilane hydrolysate, alcohol-free (DYNASYLAN 1151/HULS AG) | 0.25 | 40 | 65 | 85 |
| 1E2 | 3-glycidyloxypropyltrimethoxy-silane | 0.25 | 40 | 85 | 110 |

The test results tabulated above demonstrate the adhesion improving action of the epoxy-functional silane 3-glycidyloxypropyltrimethoxysilane in comparison with the aminosilanes employed in the prior art, especially after a relatively long storage time of the silane in the resin.

EXAMPLE 2

(Liquid Ester Curing)

2 kg of quartz sand H 31 were introduced into a planetary mixer and intensively mixed for about 3 minutes with 40 g of resin 2 to which 0.12 g of a silane was added at different intervals. Thereafter, 8 g of glycerol triacetate were added and the mixture was again mixed for a period of 3 minutes. The composition was then processed over a period of 30 minutes. The moist sand mixture was introduced into a 10-compartment wooden mold, each compartment having the dimensions 22×22×170 mm. The mixture in the mold compartments was then compacted by 10 impacts with the aid of an impact device, and the mixture projecting above the tops of the compartments was removed. After about 60 minutes the partly cured rods were removed from the molds. The flexural strength was measured with the aid of 3 test specimens in a +GF+ bending tester after different storage times under normal conditions (NC), i.e. at 50% relative atmospheric humidity and 23° C., or after storage of the test specimens for 24 hours under normal conditions and subsequent storage for 3 days at 95% relative atmospheric humidity and 23° C. (HC), i.e. under humid conditions.

The following Table shows the average test result values, the range of scatter of the individual values being very low.

TABLE 2

| Specimen No. | Silane | Storage time of silane/resin mixture [days] | Storage condition of the test specimens | Flexural strength [N/cm²] After 2 hrs | 4 hrs | 24 hrs |
|---|---|---|---|---|---|---|
| 2A1 | no silane | — | NC | 10 | 10 | 20 |
| 2B1 | 3-aminopropyltriethoxysilane, technical-grade | 1 | NC | 100 | 120 | 170 |
| 2C1 | 3-aminopropyltriethoxysilane, | 1 | NC | 120 | 130 | 180 |
| 2D1 | 3-glycidyloxypropyltrimethoxy-silane | 1 | NC | 120 | 170 | 195 |
| 2E1 | Formulation of 3-glycidyloxy-propyltrimethoxysilane and iso-butyltrimethoxysilane in a weight ration of 3:1 | 1 | NC | 110 | 140 | 195 |
| 2F1 | 3-glycidyloxypropyltriethoxy-silane | 1 | NC | 125 | 185 | 225 |
| 2A2 | no silane | — | | | | 0 |
| 2B2 | 3-aminopropyltriethoxysilane, technical-grade | 70 | NC | | | 30 |
| 2D2 | 3-glycidyloxypropyltrimethoxy-silane | 70 | NC | | | 105 |
| 2F2 | 3-glycidyloxypropyltriethoxy-silane | 70 | NC | | | 145 |
| | | | | | 24 h NC + 3 days HC | |
| 2A3 | no silane | — | HC | | | 0 |
| 2B3 | 3-aminopropyltriethoxysilane, technical-grade | 2 | HC | | | 160 |
| 2C3 | 3-aminopropyltriethoxysilane, | 2 | HC | | | 165 |
| 2D3 | 3-glycidyloxypropyltrimethoxy-silane | 2 | HC | | | 185 |
| 2E3 | Formulation of 3-glycidyloxy-propyltrimethoxysilane and iso-butyltrimethoxysilane in the weight ration of 3:1 | 2 | HC | | | 185 |
| 2F3 | 3-glycidyloxypropyltriethoxy-silane | 2 | HC | | | 210 |

The results tabulated above demonstrate the adhesion-improving action of the epoxy-functional silanes, especially that of 3-glycidyloxypropyltriethoxysilane, in comparison with the aminosilanes used in the prior art, especially after a relatively long storage time of the silane in the resin and under exposure to high humidity.

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

We claim:

1. The method of promoting the adhesion of an ester-curing resin binder for the foundry industry, which comprises adding to said ester-curing resin binder a silane of the formula

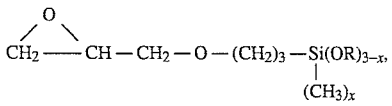

(I)

wherein R is alkyl of 1 to 8 carbon atoms or aryl, and x is 0 or 1, or a mixture of a silane of the formula I with an alkylsilane of the formula

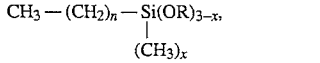

(III)

wherein R and x have the same meaning as in formula I, and n is an integer from 1 to 17, inclusive.

2. An ester-curing resin binder for the foundry industry, said binder containing an effective amount of a silane adhesion promoter of the formula

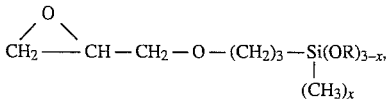

(I)

wherein R is alkyl of 1 to 8 carbon atoms or aryl, and x is 0 or 1, or a mixture of a silane of the formula I with an alkylsilane of the formula (III)

wherein R and x have the same meaning as in formula I, and n is an integer from 1 to 17, inclusive.

* * * * *

UNITED STATES PATENT AND TRADEMARK OFFICE

CERTIFICATE OF CORRECTION

PATENT NO. : 5,459,182
DATED : October 17, 1995
INVENTOR(S) : Hermann Peeters; Reinhard Matthes It is certified that error appears in the above-indentified patent and that said Letters Patent is hereby corrected as shown below:

Column 2, line 5, "(III)", should read -- (II) --;

Column 3, line 62, "i", should read -- 1 --;

Column 6, lines 41 and 60, in each instance, "(III)", should read -- (II) --.

Signed and Sealed this

Tenth Day of June, 1997

*Attest:*

*Attesting Officer*

BRUCE LEHMAN

*Commissioner of Patents and Trademarks*